US006446459B1

(12) United States Patent
Sawhney et al.

(10) Patent No.: US 6,446,459 B1
(45) Date of Patent: Sep. 10, 2002

(54) COMPACT REFRIGERATOR

(76) Inventors: Ravi K. Sawhney, 23327 Park Columbo, Calabasas, CA (US) 91302; Lance G. Hussey, 84 High Knoll Ct., Simi Valley, CA (US) 93065; Craig R. Steele, 1712 Elm Ave., Manhattan Beach, CA (US) 90266; Val Kalyuzhny, 8028 Wynne Ave., Reseda, CA (US) 91335

( * ) Notice: Subject to any disclaimer, the term of this patent is extended or adjusted under 35 U.S.C. 154(b) by 0 days.

(21) Appl. No.: 10/001,035

(22) Filed: Nov. 15, 2001

Related U.S. Application Data

(60) Provisional application No. 60/329,723, filed on Oct. 18, 2001.

(51) Int. Cl.[7] ..... F25D 11/02

(52) U.S. Cl. ..... 62/440; 62/3.6; 62/382

(58) Field of Search ..... 62/3.6, 3.62, 440, 62/441, 457.1, 457.7, 457.9, 382; 312/214, 236

(56) References Cited

U.S. PATENT DOCUMENTS

| | | | | |
|---|---|---|---|---|
| 1,782,523 A | * | 11/1930 | Warren | |
| 2,455,182 A | * | 11/1948 | Vallee | 62/116 |
| 2,893,805 A | * | 7/1959 | Ferguson | 312/214 |
| 4,898,294 A | * | 2/1990 | Jennings | 220/3.1 |
| 5,524,440 A | * | 6/1996 | Nishioka et al. | 62/3.6 |
| 6,253,568 B1 | * | 7/2001 | Peffley | 62/441 |

* cited by examiner

*Primary Examiner*—Denise L. Esquivel
*Assistant Examiner*—Melvin Jones

(57) ABSTRACT

A compact refrigerator has an insulated enclosure for the cooling and temporary storage of items, a content storage drawer that is fully exposed by pulling open the drawer from the insulated enclosure, the drawer is supported on the bottom side by at least one rolling element, and a latched handle for opening the drawer that is placed near the top of the drawer. Access to the entire content space by first pulling the ergonomically designed handle. The user then pulls open the drawer, which slidably moves away from the main housing to expose all of the content space for viewing. The content space, and the contents, move with the door, to be fully exposed when the door is in the open position. Items to be placed inside for cooling are placed into easily viewed open spaces within the contents space.

26 Claims, 3 Drawing Sheets

COMPACT REFRIGERATOR

CROSS REFERENCE TO RELATED APPLICATIONS

This application is based on provisional application Ser. No. 60/329,723 filed Oct. 18, 2001.

BACKGROUND OF THE INVENTION

This invention relates generally to the field of refrigerators, and more particularly to compact refrigerator allowing the contents of the refrigerator to be easily exposed.

Refrigerators of all sizes and types have been manufactured over the years. Most refrigerators intended for widespread consumer usage are comprised of insulated walls enclosing a volume that is used to store items the user wishes to keep cold. Access to the contents is normally accomplished by opening a door, searching the entire volume for the desired item, and withdrawing the item, sometimes necessitating rearranging the contents of the refrigerator in the process. Large refrigerators are normally used to fill the food storage needs of an entire family, and smaller units have been marketed for individuals, dorm rooms, offices and the like.

Many patents have been issued for inventions addressing the function of the refrigeration mechanism, the multitude of storage systems within various refrigerators, and mechanical improvements to parts of the typical refrigerator. Most deal with specific functions like chiller drawers, refrigeration compressor improvements, storage containers and their opening/closing mechanisms, and the like.

Many patents have been issued for inventions addressing the function of the refrigeration mechanism (peltier devices, conventional and scroll refrigeration compressors), the multitude of storage systems within various refrigerators, and mechanical improvements to hinges, latches, and other mechanical parts of the typical refrigerator, hereby incorporated by reference. None of the known patents specifically solve the problem many users have, which is to provide a small, convenient, easily accessible refrigerator in which to place items. There exist small refrigerators, but they are simply small size versions of larger family refrigerators, without addressing the problem of access to contents. If placed under a users desk, the door becomes hard to access, the user must squat down to first open, then access the contents, crawling around and placing items on the floor until finding the desired item, then replacing the other items. The power cord is often a problem, as an electrical outlet may not be nearby. The appearance is often lacking in style, most small refrigerators being made of sheet metal in plain white, or woodgrain vinyl prints.

BRIEF SUMMARY OF THE INVENTION

An object of the invention is to provide a small personal refrigerator for office, home, or other use.

In accordance with a preferred embodiment of the present invention, a compact refrigerator comprises an insulated enclosure for the cooling and temporary storage of items, a content storage drawer that is fully exposed by pulling open the drawer from the insulated enclosure, the drawer supported on the bottom side by at least one rolling element, and a latched handle for opening the drawer that is placed near the top of the drawer.

Access to the entire content space is accomplished in the preferred embodiment by first pulling the ergonomically designed handle. The user then pulls open the drawer, which slidably moves away from the main housing to expose all of the content space for viewing. The contents are placed on shelves attached to the door and which travel with the door; in essence, the content space, and the contents, move with the door, to be fully exposed when the door is in the open position. Items are easily added or removed from the contents space. Items to be placed inside for cooling are placed into easily viewed open spaces within the contents space. Once the user is finished exchanging contents, the door is pushed closed.

Other objects and advantages will become apparent from the following descriptions, taken in connection with the accompanying drawings, wherein, by way of illustration and example, an embodiment of the present invention is disclosed.

BRIEF DESCRIPTION OF THE SEVERAL DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiments are provided herein. It is to be understood, however, that the present invention may be embodied in various forms. Various aspects of the invention may be inverted, or changed in reference to specific part shape and detail, part location, or part composition. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
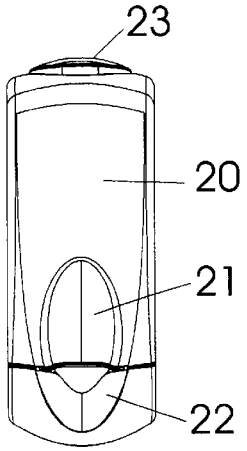
FIG. 1 is a top view of a compact refrigerator in accordance with a preferred embodiment of the present invention.
Figure 2:
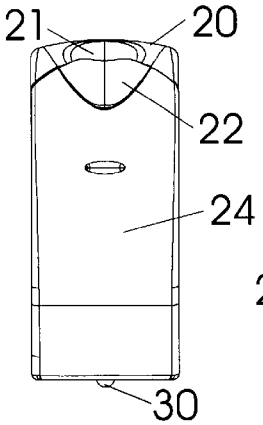
FIG. 2 is a front view of the compact refrigerator of FIG. 1.
Figure 4:
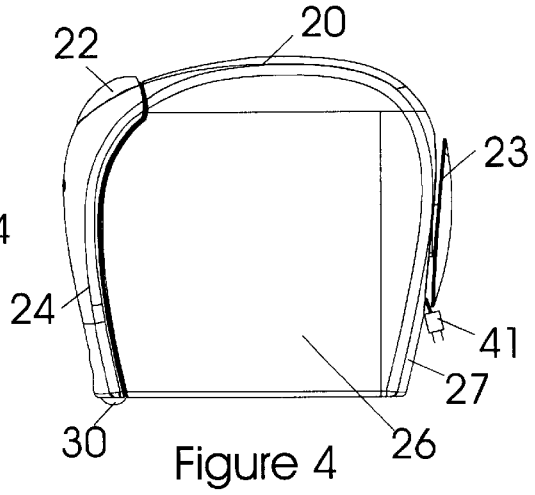
FIG. 4 is a side view of the compact refrigerator of FIG. 1.
Figure 5:
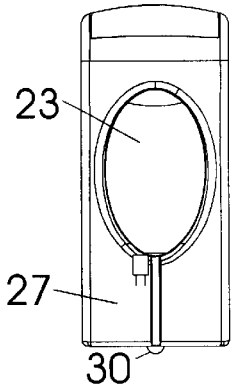
FIG. 5 is a back view of the compact refrigerator of FIG. 1.
Figure 3:
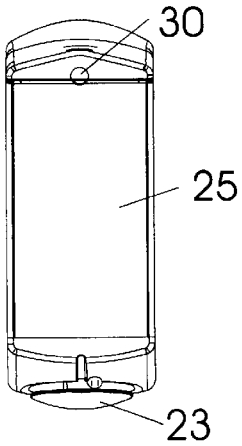
FIG. 3 is a bottom view of the compact refrigerator of FIG. 1.

FIGS. 1 through 5 show the exterior views of a preferred embodiment of the invention. FIG. 1 shows top housing 20, handle recess 21, handle 22, and cord wrap 23. FIG. 2 shows door 24, wheel 30, handle 22, handle recess 21, and top housing 20. FIG. 3 shows bottom housing 25, cord wrap 23, and wheel 30. FIG. 4 shows side housing 26, along with back housing 27, cord wrap 23, top housing 20, handle 22, front housing 24, and wheel 30. FIG. 5 shows back housing 27, wheel 30, and cord wrap 23. Top housing 20, side housing 26 (symmetrical for left and right sides), back housing 27, and bottom housing 25 may be permanently joined at the edges or molded in one piece as a five sided insulated enclosure.

Figure 6:
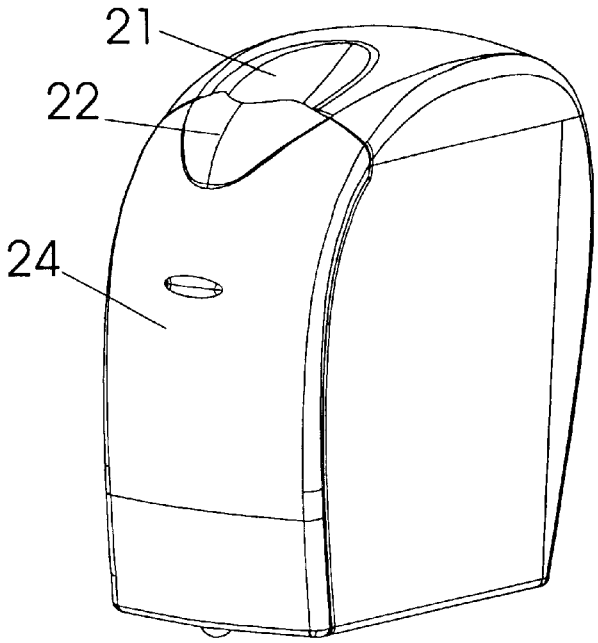
FIG. 6 is a perspective view of the compact refrigerator of FIG. 1 in the closed position.
Figure 7:
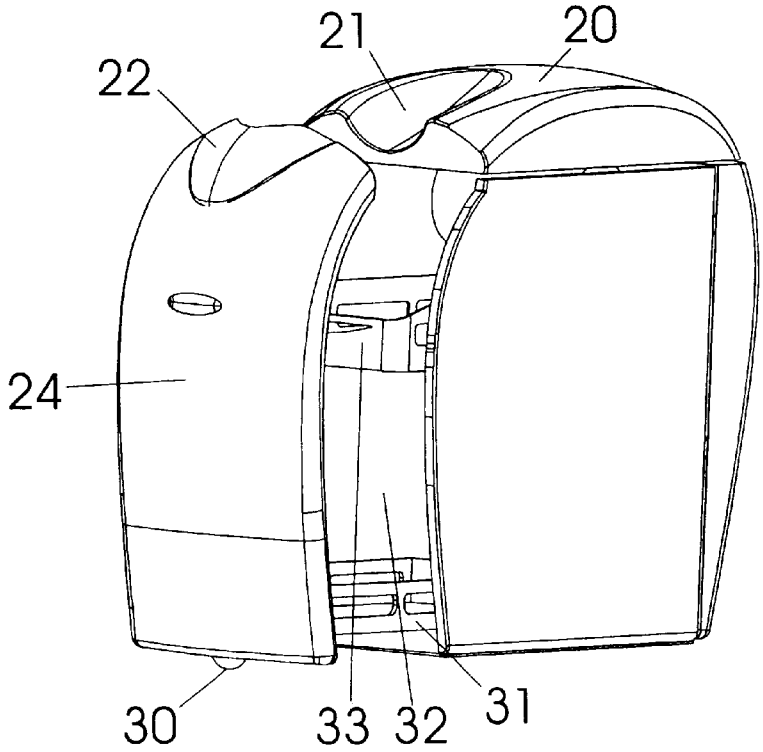
FIG. 7 is a perspective view of the compact refrigerator of FIG. 1 in the partially open position.

Turning now to FIG. 6 there is shown a preferred embodiment of the invention in the closed position. Handle 22 is placed at the top of door 24, providing easy access to open door 24. Handle recess 21 provides access for the user to grab handle 22 from above or from the front. FIG. 7 shows the refrigerator in a partially open position. Door 24 is unlatched from top housing 20 by pulling on handle 22, and moves slidably forward on wheel 30, guided by slides 31. Opening door 24 fully exposes content space 32, in which may be placed or remove contents, potentially utilizing space organizing features such as one embodiment of a compartment element 33 shown here.

Figure 8:
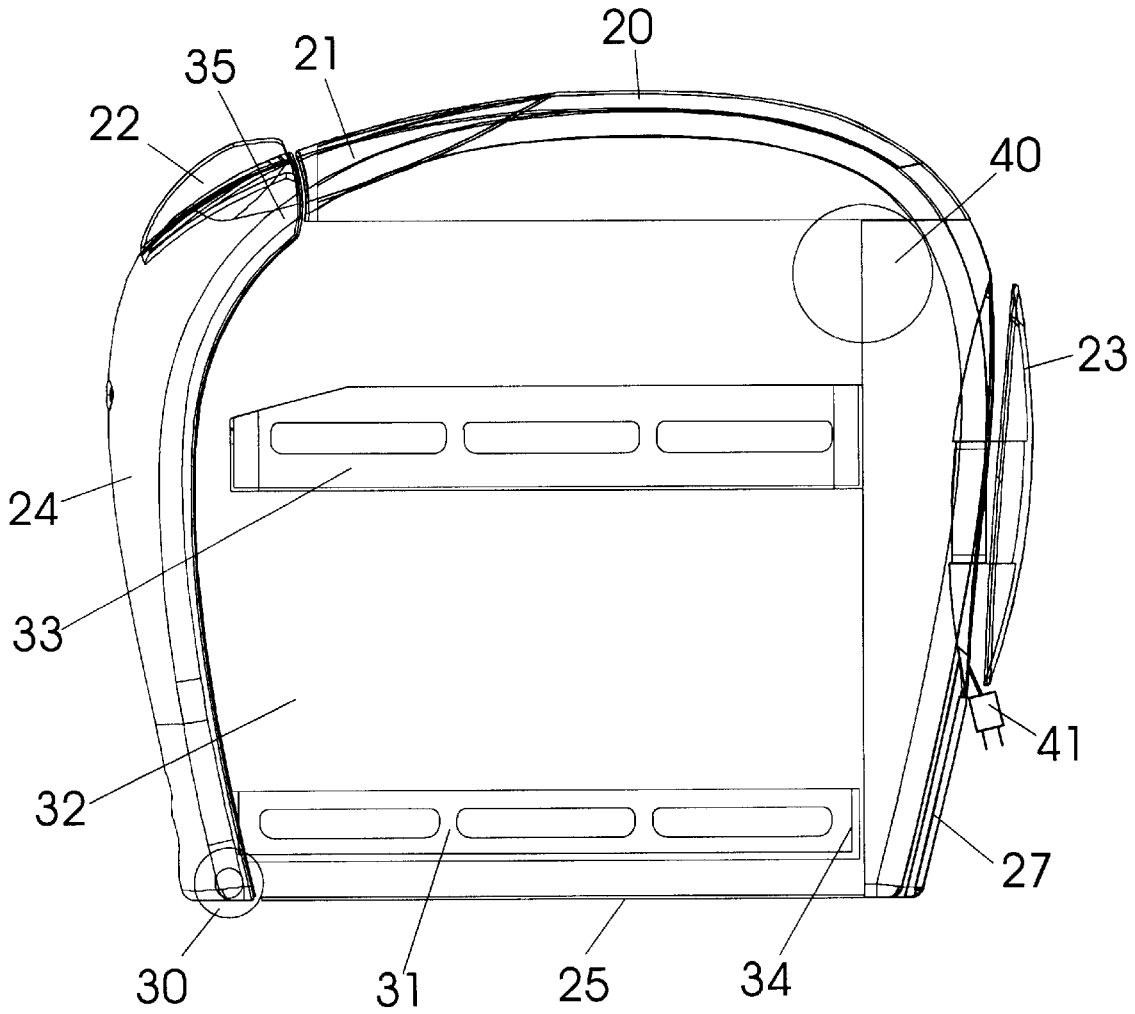
FIG. 8 is a cross-sectional view of the compact refrigerator of FIG. 1.

Turning now to FIG. 8, the section of the invention in the closed position is shown, through front housing 24, handle 22, top housing 20, back housing 27, cord wrap 23, bottom housing 25, and wheel 30. Refrigeration unit 40 is placed in the top rear of the unit to make good use of the interior space; cooling can be accomplished by peltier device, compact conventional or scroll refrigeration compressor, numerous examples of which can be found and are hereby incorporated by reference, Access to the content space 32 is gained by pulling upwardly and forwardly on handle 22, which releases door 24 from the top housing 20 by activating latch 35, allowing door 24, wheel 30, slides 31, and compartment elements 33, comprising content space 32, to move forward. Wheel 30 supports door 24 when the unit is opened, and content space 32 is guided by slides 31 as door 24 is pulled forward by the user. At the fully open position, content space 32 is stopped from traveling by the stop 34, which can be released by the user in order to fully remove the content space 32 for cleaning. Content space 32 can be configured for varying arrangements of contents by the use of compartment elements 33, only one example of the many possibilities of which is shown. Power cord 41 emanates from refrigeration unit 40 and exits rear housing 27 at the bottom of the cord wrap 23. The user may adjust the exposed length of power cord 41, shortening the exposed length by wrapping the excess around cord wrap 23.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims. Alternate embodiments of the refrigerator access function:

1 The top surface and front door surface open simultaneously, latching at the top front edge and pivoting at the bottom and rear edges, providing access to the contents initially from the top front corner, and to more of the contents space as the doors open further. The door actuation and movement could alternatively be provided by an electric motor.

2 The wide side surface opens hingeably, hinged at the rear and latched at the front. The user can access all contents, which are placed on shelves provided on the inside of the door. The door actuation and movement could alternatively be provided by an electric motor.

3 The wide side surface is attached hingeably to the bottom of the housing, and opens from the top, providing access to the contents space. The door actuation and movement could alternatively be provided by an electric motor.

4 The front door is split into two sections along the central vertical axis, which slide outwardly from the center to provide access to the contents space. The door actuation and movement could alternatively be provided by an electric motor.

5 The front door is split into two sections along the central vertical axis, and each section is hingeably attached to the housing sides, and pivot outwardly from the center to provide access to the contents space. The door actuation and movement could alternatively be provided by an electric motor.

6 The top and front sides are both accessible by tambour-type doors, which slide open to provide access from either the front, the top, or diagonally from the top front corner. The door actuation and movement could alternatively be provided by an electric motor.

7 The front door is divided into two or more drawers, which slide out individually to provide access to the contents placed in the drawers. The door actuation and movement could alternatively be provided by an electric motor.

8 The front door is opened by pulling the handle at the top, which allows a combination action such that as the door slides forward away from the main housing, the door also pivots downward, thus exposing the entire content space. The door actuation and movement could alternatively be provided by an electric motor.

9 The front door is divided into two panels joined by a hinge, such that the user can access just the top portion of the contents space by opening the top panel. The remainder of the contents space is accessed by pulling the door open, as in the preferred embodiment. The door actuation and movement could alternatively be provided by an electric motor.

10 The front of the contents space is accessed only from the front, which is covered by a flexible insulated membrane that opens by pulling on the lower edge, as in a roll-up window shade.

11 The front of the contents space is accessed only from the front, which is covered by a flexible insulated membrane that is divided by a slit; access to the contents space is made through the slit.

12 The chassis, comprising the base, joined fixedly to the front and back panels, the back panel containing the cooling element and power supply, defines the content space. The cover, comprising a top panel, joined fixedly to a wide side panel on both of its two long sides, said cover is attached slidably to the top of the chassis such that the contents space is accessed by sliding the cover towards the front or back panel, thus revealing the contents space in its entirety. The cover actuation and movement could alternatively be provided by an electric motor.

13 The front door opens by pulling the handle as in the preferred embodiment, but the door is joined hingeably at the base, and pivots downwards as the door opens, pulling out by means of pivoting linkages one or more internal shelves containing the contents. The door actuation and movement could alternatively be provided by an electric motor.

14 The Content space can be accessed by opening the front door, which is attached hingeably to the housing such that it opens like a conventional door. The door actuation and movement could alternatively be provided by an electric motor.

15 The contents space can be accessed by opening the front door, which slides upwardly from the bottom, as in a guillotine. The door actuation and movement could alternatively be provided by an electric motor.

16 The entire refrigerator is mounted to the underside of a desktop or countertop, elevating it from the floor and providing more convenient access to the user.

17 The top of the invention contains a closeable opening into which is poured water or other liquids to be cooled. The opening is sealably connected to a container within the interior of the invention, where the liquid is cooled and awaits dispensing at the users convenience. Dispensing can be by gravity feed, electric or pneumatic pump, or by other means well known in the art.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A refrigerator comprising:

an insulated enclosure having an interior for cooling and storing items, the insulated enclosure further having an open first side for access to the interior;

a moveable carriage for holding items to be cooled, the moveable carriage being supported for movement through the open first side of the insulated enclosure;

a door coupled to the carriage for movement with the carriage between a first position in which the open first side of the insulated enclosure is substantially covered by the door and a second position in which the open first side of the insulated enclosure is at least partially exposed;

wherein the door has a first end disposed adjacent an enclosed second side of the insulated enclosure when the door is in the first position, the door further having a handle adjacent the first end of the door; and wherein the enclosed second side of the insulated enclosure has a recess for allowing access to the handle when the carriage is in the first position.

2. The refrigerator of claim 1, wherein the door and the carriage slide between the first position and the second position.

3. The refrigerator of claim 1, wherein the handle is moveable away from the insulated enclosure.

4. The refrigerator of claim 1, wherein the handle is moveable away from the door.

5. The refrigerator of claim 1, wherein the door simultaneously slides and pivots away from the insulated enclosure.

6. The refrigerator of claim 1, wherein the door slides away from an enclosed third side of the insulated enclosure.

7. The refrigerator of claim 1, wherein the insulated enclosure comprises an enclosed fourth, an enclosed fifth side and an enclosed sixth side, wherein the enclosed fifth side and enclosed sixth side are parallel to each other.

8. The refrigerator of claim 7, wherein the enclosed second side, enclosed third side, enclosed fourth side, enclosed fifth side and enclosed sixth side are permanently joined at their respective edges.

9. The refrigerator of claim 7, wherein the enclosed second side, enclosed third side, enclosed fourth side, enclosed fifth side and enclosed sixth side of the insulated enclosure are molded into one piece.

10. The refrigerator of claim 7, wherein the enclosed first side of the insulated enclosure and the door open simultaneously, latching at a first edge of the insulated enclosure and pivoting at second and third edges of the insulated enclosure.

11. The refrigerator of claim 7, wherein the door is hinged at the enclosed fourth side of the insulated enclosure.

12. The refrigerator of claim 7, wherein the door is hinged at the enclosed third side of the insulated enclosure and opens from an area adjacent the enclosed second side of the insulated enclosure.

13. The refrigerator of claim 1, further comprising:

a latch for latching the door to the insulated enclosure;

a refrigeration unit positioned at an area adjacent the enclosed fourth side of the insulated enclosure;

a rolling element coupled to the door for assisting movement of the door;

slides affixed to the door and the insulated enclosure for guiding movement of the door;

compartment elements for configuring the interior of the insulated enclosure; and a stop located adjacent the slides for stopping the carriage, the stop being releasable to remove the carriage from the insulated enclosure.

14. The refrigerator of claim 1, wherein the door comprises two sections along a vertical axis.

15. The refrigerator of claim 14, wherein the two sections are slidably moveable.

16. The refrigerator of claim 14, wherein the two sections are hinged to the insulated enclosure.

17. The refrigerator of claim 1, wherein the door is divided into at least two drawers.

18. The refrigerator of claim 1, wherein the door comprises two panels joined by a hinge.

19. The refrigerator of claim 1, wherein the carriage is covered by a flexible, insulated membrane.

20. The refrigerator of claim 19, wherein the flexible, insulated membrane rolls up.

21. The refrigerator of claim 19, wherein the flexible, insulated membrane comprises a slit.

22. The refrigerator of claim 1, wherein the enclosed second side of the insulated enclosure comprises a slidably moveable cover.

23. The refrigerator of claim 7, wherein the door is hingedly attached to the enclosed second side of the insulated enclosure and pivots away from the insulated enclosure as the door moves to the second position.

24. The refrigerator of claim 7, wherein the enclosed second surface comprises a closable opening for accepting liquids to be cooled, and wherein the insulated enclosure comprises a dispenser for dispensing the liquids.

25. A method for accessing a refrigerator, the refrigerator having an insulated enclosure, the insulated enclosure having an interior for cooling and storing items, the insulated enclosure further having an open first side for access to the interior, the refrigerator also having a carriage for holding items to be cooled, the moveable carriage being supported for movement through an open first side of the insulated enclosure, the refrigerator also having a door coupled to the carriage, the method comprising:

engaging a handle through a recess, the handle located at a first end of the door, the recess located at a first end of the insulated enclosure adjacent the handle; and pulling on the handle to move the door and the carriage away from the insulated enclosure.

26. The method of claim 25, wherein pulling on the handle to move the door and the carriage away from the insulated enclosure comprises sliding the door and the carriage away from the insulated enclosure.

* * * * *